United States Patent [19]

Desai

[11] Patent Number: 4,696,502

[45] Date of Patent: Sep. 29, 1987

[54] DUAL STRING PACKER MILL

[75] Inventor: Praful C. Desai, Kingwood, Tex.

[73] Assignee: Smith International, Newport Beach, Calif.

[21] Appl. No.: 767,039

[22] Filed: Aug. 19, 1985

[51] Int. Cl.[4] ..... E21B 31/16; E21B 31/20

[52] U.S. Cl. ..... 294/86.17; 166/98; 166/99; 294/86.18; 294/86.25; 294/86.34

[58] Field of Search ..... 166/98, 99; 175/385, 175/387; 294/86.34, 86.17, 86.18, 86.25, 86.12, 86.2, 86.21, 86.3, 86.32, 86.33

[56] References Cited

U.S. PATENT DOCUMENTS

| | | | |
|---|---|---|---|
| 1,445,680 | 2/1923 | Guess | 294/86.25 |
| 1,789,247 | 1/1931 | Miller | 294/86.21 |
| 1,903,109 | 3/1933 | Hampton | 294/86.17 |
| 2,904,114 | 9/1959 | Webb et al. | 175/385 X |
| 3,019,840 | 2/1962 | Kennard | 294/86.24 |
| 3,095,926 | 7/1963 | Rush | 294/86.18 |
| 3,131,762 | 5/1964 | Dye | 294/86.34 |
| 3,150,718 | 9/1964 | Crowe | 294/86.17 |
| 3,352,593 | 11/1967 | Webb | 294/86.34 |
| 4,616,721 | 10/1986 | Furse | 294/86.18 X |

FOREIGN PATENT DOCUMENTS 916579 1/1963 United Kingdom .

*Primary Examiner*—James A. Leppink
*Assistant Examiner*—Hoang C. Dang
*Attorney, Agent, or Firm*—Christie, Parker & Hale

[57] ABSTRACT

A dual string packer is milled by a mill having an annular milling shoe for milling the periphery of the packer and freeing it from the well bore. An axial milling head mills a central hole in the top of the packer before the annular shoe reaches the locking segments. A grapple above the milling head engages the walls of the axial hole to support the remains of the packer in the well. The grapple includes a release ring that can be broken in tension to release the packer mill from a stuck packer if need be. The grapple has a gripper sleeve with longitudinally extending fingers and a camming sleeve for camming the fingers outwardly. An expandable ring inside the camming sleeve provides means for withdrawing the camming sleeve from the gripper sleeve if it should stick.

9 Claims, 2 Drawing Figures

DUAL STRING PACKER MILL

BACKGROUND OF THE INVENTION

This invention concerns a mill for removing a packer from an oil well or the like.

A packer is a device placed in the steel casing of an oil well for isolating upper and lower sections of such casing. In a dual string packer there are two non-axial bores and surrounding structure that seals the packer inside the casing. Tubing can be connected to or through the packer for injecting and/or withdrawing fluids from the well. A broad variety of packers are commercially available and the structure thereof is of no significance for this invention.

Some dual string packers are designed for release so that they can be readily removed from the casing and others are more or less permanently fixed in the casing. Even with the readily removable packers it often occurs that corrosion or the like prevents removal. Thus, it is not an uncommon procedure in work-over of oil wells to require milling of the packer to remove it from the well. Such milling destroys the packer and milling chips are pumped out of the well or are caught in downhole debris collectors. Junk that remains in the well can be removed with a magnet or can be milled by a conventional junk mill.

As milling of a packer continues a point is ordinarily reached where the remains of the packer and any tubing or the like hanging from it are freed from the casing and may fall free. A packer mill for single completion packers has a grip or catcher on the milling tool used to mill the packer that catches the remains of the milled packer so that they can be drawn upwardly and removed from the well bore.

It sometimes occurs as the remains of the packer are lifted that they become stuck in the well bore. It may also occur that the milling tool becomes worn or damaged before the packer is free. In either of these circumstances it may be desirable to remove the milling tool while leaving the remainder of the packer in the well. It is therefore desirable to provide a means for releasing the packer mill from the packer. The mill can then be withdrawn and the well reentered with the same or a different tool for completing removal of the packer.

One novel approach for a single completion packer is disclosed in U.S. patent application Ser. No. 675,354 filed on Nov. 27, 1984, now U.S. Pat. No. 4,616,721, the subject matter of which is hereby incorporated by reference. This packer mill has a catcher sleeve with radially collapsible fingers which can pass through the bore of a single completion packer and expand once through the bore. When the packer is milled free, it falls to the catcher for lifting from the well. In the event the packer sticks in the well, the catcher can release by lifting hard. This causes bursting of a tension ring at the ends of the fingers. When the ring snaps, the catcher can contract, releasing the packer, and the packer mill can be withdrawn.

However, the packer mill of application No. 675,354 is a single completion packer mill that has a long catcher that extends below the central bore of the packer and supports the packer at the bottom. This mill and catcher cannot be used on a dual string packer which lacks a central bore. It is therefore desirable to provide a packer mill usable for a dual string packer, which will support the remains of the packer when freed in the well.

It is usual that the packer has the grips or locking sections that secure it in the well bore at or below the middle of the packer. When milling a stuck packer it does not ordinarily break free until at least a portion of the locking sectors have been milled. This means that much of the length of the packer must be milled at appreciable cost.

It is desirable to minimize the amount of the packer that is milled since the less metal removed by milling, the quicker the job can be completed. It is also important to remove the residual parts of the packer when less than all of it is milled since that is by far the most economical way to clean up the well.

It is also desirable to provide a means for releasing a packer mill from the remains of a packer that is stuck in the well with a high degree of reliability and without inherently producing loose parts that may cause further difficulty in the well bore.

SUMMARY OF THE INVENTION

There is, therefore, provided in practice of this invention according to a presently preferred embodiment a packer mill that includes an annular milling shoe for milling the outer perimeter or surface of the packer to free the packer from the well bore and an inner milling head that mills a portion of the center of the dual string packer before the outer milling shoe mills the packer bore locking segments.

The inner milling head is mounted at the lower end of a mandrel. A longitudinally slidable grapple or gripper sleeve having a plurality of downwardly extending fingers is mounted on the mandrel. A camming sleeve is also mounted on the mandrel inside the fingers for camming the fingers outwardly. A release ring is mounted adjacent to an enlarged section of the mandrel and engaging the lower end of the camming sleeve to prevent downward movement thereof. There are complementary ramps on the release ring and the enlarged portion for camming the ring outwardly in response to downward force on fingers. This camming tends to enlarge the ring, which fails in tension at a preselected force, releasing the camming sleeve. Means may be provided for withdrawing the camming sleeve from within the gripper sleeve upon downward motion of the mandrel.

DRAWINGS

These and other features and advantages of the present invention will be readily appreciated by reference to following detailed description when considered in connection with the accompanying drawings wherein:

FIG. 1 is a side view, half of which is in longitudinal cross section, of a dual string packer mill constructed according to principles of this invention; and FIG. 2 an enlarged fragmentary cross section of the release portion of the dual string packer mill.

DETAILED DESCRIPTION

Figure 1:
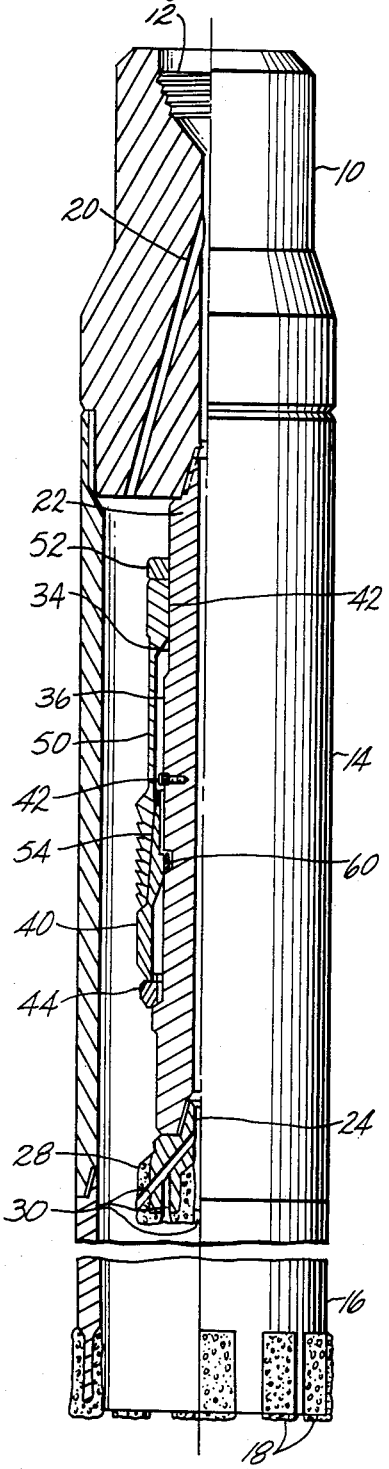

FIG. 1 shows the dual string packer mill of the present invention in side view with the left half of the drawing in cross section to illustrate the internal mechanism. The upper portion of the packer mill comprises a cylindrical steel body 10 having a threaded box 12 at its upper end for connection to a drill string. The body is threaded at its lower end for connection of a tubular steel body extension 14. An annular milling shoe 16 is attached to the tubular steel body extension at its lower end. The outer milling shoe has a plurality of cutting pads 18 faced or dressed with a conventional hard facing material such as pieces of cemented tungsten carbide in a matrix of brazing alloy. A continuous dressing of carbide can be used on the milling shoe if desired. Fluid ports 20 through the cylindrical steel body 10 direct drilling fluid from the inside of the body into the extension 14 to flow through the region around the cutting pads for removing milling chips and the like.

A rigid mandrel 22 is threaded into the bottom portion of the upper body coaxially within the tubular steel body extension. An inner milling head 24 is threaded to the lower end of the mandrel. The lower face of the inner milling head is dressed with a hard facing material 28, such as particles of cemented tungsten carbide in a brazing alloy matrix. An exemplary inner milling head has three lobes and an effective diameter about the same as the diameter of the device for catching the milled packer when it is free. A plurality of ports 30 in the lower face of the inner milling head discharge drilling fluid through the head for removing milling chips and other debris from this region.

When the packer mill is used, the tubular steel body extension 14 and outer milling shoe act as a pilot and guide the packer mill above the packer to land the outer milling shoe on the outer perimeter of the packer. It sometimes occurs that there is junk or other obstruction in the well bore above the packer and the outer milling shoe cuts away such obstructions so that the outer milling shoe can engage the outer perimeter of the packer and permit the cutting pads on the annular milling shoe to mill the outer periphery of the packer. Alternatively, a junk mill can be run to clean the well above the packer.

The annular milling shoe is much further below the body than the milling head on the mandrel. Thus the shoe lands on the packer and mills aways much of the length of the periphery before the central milling head commences milling an axial hole into the upper end of the packer. This minimizes the total quantity of metal that needs to be milled for removing the packer.

Figure 2:
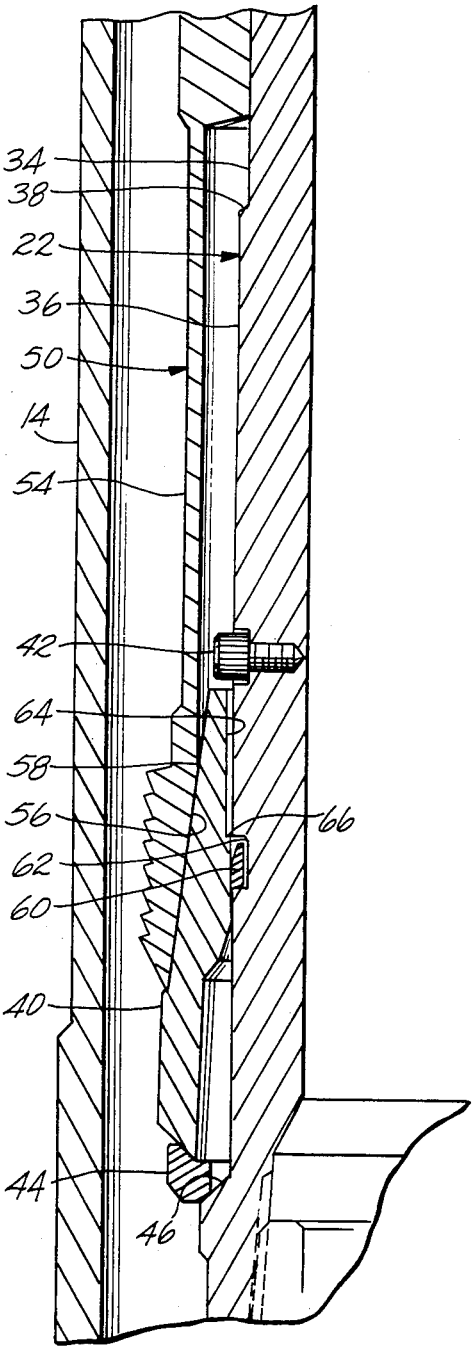

The central mandrel 22 has an upper relief portion 34 having a reduced diameter. There is also a middle relief portion 36 with a reduced diameter; however, the diameter of the middle relief portion is greater than the diameter of the upper relief portion to provide a shoulder 38. These relief portions are illustrated in greater detail in the fragmenteary cross section of FIG. 2.

A camming sleeve 40 fits on the mandrel so that it can slide a short distance longitudinally and can rotate freely on the mandrel. A plurality of cap screws 42 above the camming sleeve limit its upward travel. A release ring 44 rests on a shoulder 46 at the lower end of the middle relief portion of the mandrel. The bottom face of the camming sleeve rests on the top of the release ring 44. The upper face of the shoulder 46 has a tapered or conical ramp and there is a complementary ramp surface on the release ring. Both ramps extend at a 45° angle from the axis of the mill, which is the angle of maximum shear stress with an axial force applied between the ring and mandrel.

The upper end of the gripper sleeve or grapple 50 slidably engages the upper relief portion 34 of the mandrel 22 for longitudinal motion. A thrust bearing ring 52 at the upper end of the gripper sleeve limits the upward longitudinal motion of the sleeve when the bearing ring engages the bottom of the body 10. The bearing ring also permits rotation of the gripper sleeve on the mandrel so that the sleeve can remain fixed against a packer as the mandrel rotates. The gripper sleeve has a plurality of longitudinal slits (not shown) which divide the lower portion of the sleeve into a plurality of downwardly extending fingers 54. An inner face 56 of the fingers rests on the tapered outer face 58 of the camming sleeve for expanding the fingers outwardly when the gripper sleeve moves longitudinally downwardly. The outer faces of the fingers are serrated with a plurality of annular sawtooth ridges adapted to engaging the walls of a hole milled into the packer by the inner milling head. The teeth are asymmetrical to ease entry into a hole in a packer and resist withdrawal from such a hole.

When the milling of the packer commences, the annular milling shoe 16 cuts away a portion of the periphery of the packer. Drilling fluid circulated into the interior of the tubular extension 14 through the passages 20 and 30 passes over the cutting face of the milling shoe and up the annulus surrounding it for removing chips.

The length of the extension 14 and mandrel 22 are selected so that when the annular milling shoe reaches approximately one-half meter above the locking segments that secure the packer in the hole, the inner milling head contacts the top of the packer. Since a dual string packer does not have a central bore for receiving a catcher, the central milling head mills an axial hole into the top of the packer. By having the milling head at an elevation well above the elevation of the annular shoe, only enough of a central hole to support the packer is milled into the upper end of the packer.

As milling of the central hole proceeds, the serrations on the fingers of the gripper sleeve engage the walls of the hole being made through the packer by the milling head. Initially this causes the gripper sleeve to be pushed upwardly until the thrust bearing ring 52 engages the bottom of the upper body. Movement of the gripper sleeve up the ramp on the camming sleeve permits the fingers to collapse radially inwardly until the outside diameter across the serrations is no smaller than the diameter of the hole being made by the milling head and is preferably only slightly larger than the hole being milled so as to fit in easily. The gripper sleeve is free wheeling on the mandrel so that the serrations are merely pressed downwardly into the hole as the mandrel rotates.

By the time the annular milling shoe starts milling away the locking segments that secure the packer in the well bore, the serrations on the gripping fingers are securely pressed into the axial hole through the packer. When the locking segments are milled away sufficiently to release the packer from the well, the serrations on the grapple prevent the packer from falling down in the hole. The remaining part of the packer can then be retrieved by simply pulling it up the well bore. If the packer is tight in the bore, and pulls downwardly, the fingers sliding down the ramp surface on the camming sleeve are forced radially outwardly for more tightly gripping the remains of the packer to prevent it from falling free in the well.

In the event the packer is so tightly stuck that it cannot be pulled up by the grapple, the packer mill can be broken free and withdrawn. This is done by lifting the packer mill with sufficient force to burst the release ring 44. As the mill is lifted, the gripper sleeve presses downwardly on the camming sleeve, which in turn presses on the release ring 44. The release ring is cammed outwardly by the 45° angle on the shoulder 46 until the tensile strength of the release ring is exceeded and it breaks in the manner described in the aforementioned patent application. This frees the camming sleeve for further downward motion relative to the mandrel. The camming sleeve can move further down the mandrel than can the gripper sleeve which engages the shoulder 38 on the mandrel. When the camming sleeve moves downwardly out of the gripper sleeve, the fingers can collapse radially inwardly and release the remains of the packer.

In the event the camming sleeve does not move down under gravity, the jar of the release ring breaking, and the squeezing of the fingers, a safety release is also provided. A split expansion ring 60 is provided in a groove 62 in the mandrel. The split ring has a relaxed diameter larger than the diameter of the mandrel and is compressed by the camming ring upon assembly of the mill. When the release ring 44 bursts and the camming sleeve moves downwardly relative to the mandrel, the expansion ring snaps outwardly into an enlarged diameter portion 64 inside the upper portion of the camming sleeve.

In the event the camming sleeve does not move downwardly a sufficient distance to release the fingers from the packer mill, the mill can be set down again on the stuck packer. This causes the gripper sleeve, which still engages the packer, and the camming sleeve in the event if it still stuck to the fingers, to move up relative to the mandrel. The camming sleeve can, however, move up only until the shoulder 66 at the bottom of a relief portion 64 within the sleeve engages the expansion ring. The gripper sleeve, however, can move further, thereby releasing the camming sleeve which can fall free so that the fingers can collapse inwardly, releasing the stuck packer. The mill can thus be withdrawn from the hole leaving the packer in place.

It will be recognized that in the preceding description although it is stated that a part such as the gripper sleeve moves upwardly relative to the mandrel or the like, it may be more precise to say that the sleeve is fixed in the hole and the mandrel moves down with respect to it. The relative motion between the parts is what is effective for operating the grapple.

Although but one embodiment of packer mill constructed according to principles of this invention has been described and illustrated herein, many modifications and variations will be apparent to one skilled in the art. Many variations in the details of construction such as the location of the fluid flow passages, geometry of the cutting structure that mills the packer and the like may be employed. Modifications can also be made in the grapple for engaging and lifting, and if need be releasing a packer that is milled. For example, the expansion ring 60 might spring out and bear on a shoulder at the end of the camming sleeve instead of inside a relieved portion of the sleeve. The ramp that cams the fingers 54 outwardly may be on the camming sleeve or on the fingers instead of the preferred arrangement on both surfaces. Many other variations can be devised. It is therefore to be understood that within the scope of the appended claims the invention may be practiced otherwise than as specifically described.

What is claimed is:

1. A packer mill comprising:

an annular sleeve;

means on the lower end of the sleeve for milling the periphery of a packer;

an axial mandrel inside the sleeve;

means on the lower end of the mandrel for milling an axial hole into the upper end of a packer at an elevation above the milling of the periphery of the packer;

an axially slidable gripper sleeve on the mandrel including a plurality of longitudinally extending fingers, each of the fingers comprising outwardly facing serrations for gripping the walls of the hole in the packer;

a camming sleeve on the mandrel inside the gripper sleeve for camming the fingers radially outwardly for engaging the walls of the axial hole milled in the packer for supporting the packer;

a release ring around the mandrel engaging an end of the camming sleeve; and means for bursting the ring in hoop tension upon application of sufficient axial force between the mandrel and camming sleeve for releasing the camming sleeve for axially sliding away from the gripper sleeve for permitting the fingers to collapse radially inwardly.

2. A packer mill comprising:

an annular sleeve;

means on the lower end of the sleeve for milling the periphery of a packer;

an axial mandrel inside the sleeve;

means on the lower end of the mandrel for milling an axial hole into the upper end of a packer at an elevation above the milling of the periphery of the packer;

an axially slidable gripper sleeve on the mandrel including a plurality of longitudinally extending fingers, each of the fingers comprising outwardly facing serrations for gripping the walls of the hole in the packer;

a camming sleeve on the mandrel inside the gripper sleeve for camming the fingers radially outwardly for engaging the walls of the axial hole milled in the packer for supporting the packer;

means for releasing the camming sleeve for axially sliding away from the gripper sleeve for permitting the fingers to collapse radially inwardly;

a groove in the mandrel;

an expandable ring in the groove inside the camming sleeve; and shoulder means on the camming sleeve for permitting translation of the camming sleeve on the mandrel in one direction and engaging the expandable ring for preventing return translation of the camming sleeve in the opposite direction for withdrawing the camming sleeve away from the gripping sleeve in response to translation of the mandrel.

3. A packer mill comprising:

a body at the upper end of the packer mill;

means for connecting the body to a drill string for rotating and axially loading the packer mill;

an annular milling shoe extending downwardly from the body for milling at the periphery of a packer;

a central mandrel extending downwardly from the body inside the annular milling shoe and including a milling head for milling a central portion of the packer, the central milling head extending a lesser distance below the body than the annular milling shoe for milling a hole in only the upper end of the packer;

means on the mandrel for preventing a portion of the packer between the milling shoe and the milling head from dropping away from the packer mill comprising:

a longitudinally slidable gripper sleeve on the mandrel including a plurality of longitudinally extending fingers, each of the fingers including serrations for engaging the walls of the hole milled in the central portion of the packer; and a camming sleeve on the mandrel inside the fingers for camming the serrations into engagement with the walls of the hole, a diameter across a portion of the camming sleeve being sufficient that the outside diameter across the serrations is no less than the inside diameter of the hold in the packer so that the serrations engage the walls of the hole;

a release ring around the mandrel engaging an end of the camming sleeve; and means for bursting the ring in hoop tension upon application of sufficient axial force between the mandrel and camming sleeve for releasing the camming sleeve for axially sliding away from the gripper sleeve and permitting the fingers to collapse radially inwardly.

4. A packer mill comprising:

a body at the upper end of the packer mill;

means for connecting the body to a drill string for rotating and axially loading the packer mill;

an annular milling shoe extending downwardly from the body for milling at the periphery of a packer;

a central mandrel extending downwardly from the body inside the annular milling shoe and including a milling head for milling a central portion of the packer, the central milling head extending a lesser distance below the body than the annular milling shoe for milling a hole in only the upper end of the packer;

means on the mandrel for preventing a portion of the packer between the milling shoe and the milling head from dropping away from the packer mill comprising:

a longitudinally slidable gripper sleeve on the mandrel including a plurality of longitudinally extending fingers, each of the fingers including serrations for engaging the walls of the hole milled in the central portion of the packer; and a caming sleeve on the mandrel inside the fingers for camming the serrations into engagement with the walls of the hole, a diameter across a portion of the camming sleeve being sufficient that the outside diameter across the serrations is no less than the inside diameter of the hold in the packer so that the serrations engage the walls of the hole;

means for releasing the camming sleeve for axially sliding away from the gripper sleeve for permitting the fingers to collapse radially inwardly;

a grove in the mandrel;

an expandable ring in the groove inside the camming sleeve; and shoulder means on the camming sleeve for permitting translation of the camming sleeve on the mandrel in one direction and engaging the expandable ring for preventing return translation of the camming sleeve in the opposite direction for withdrawing the camming sleeve away from the gripping sleeve in response to translation of the mandrel.

5. A packer mill as recited in claim 3 wherein the fingers on the gripper sleeve can collapse inwardly when the sleeve is moved upwardly relative to the mandrel and are cammed outwardly when the gripper sleeve is moved downwardly relative to the mandrel.

6. A packer mill as recited in claim 5 wherein the camming sleeve has an outside ramp portion inside the lower ends of the fingers, the diameter across the upper part of the ramp being sufficient that the outside diameter across the serrations when the gripper sleeve is at its uppermost position is no less than the inside diameter of the hole through the packer, the ramp increasing in diameter in a downward direction.

7. A packer grapple comprising:

a mandrel for entering a hole in the top of a packer;

a gripper sleeve longitudinally slidable and freely rotatable on the mandrel, and subdivided at its lower end into a plurality of downwardly extending fingers, each of the fingers including serrations at its lower end for engaging the wall of the hole in a packer;

a camming sleeve having an outside ramp portion inside the lower ends of the fingers, the diameter across the upper part of the ramp being sufficient that the outside diameter across the serrations when the gripper sleeve is at its uppermost position is no less than the inside diameter of the hole in the packer so that the serrations engage the walls of the hole, the ramp increasing in diameter in the downward direction for camming the fingers radially outwardly as the gripper sleeve translates downwardly relative to the camming sleeve;

release means on the mandrel for releasing the camming sleeve for downward movement relative to the mandrel in response to an upward force on the mandrel sufficient to release the release means; and means for withdrawing the camming sleeve downwardly from the fingers in response to downward movement of the mandrel relative to the gripping sleeve.

8. A packer grapple as recited in claim 7 wherein the means for withdrawing comprises:

an expandable ring on the mandrel;

a shoulder on the camming sleeve for engaging the expandable ring for permitting movement downwardly relative to the mandrel and preventing return movement upwardly relative to the mandrel.

9. A packer grapple as recited in claim 8 wherein the release means comprises a release ring around the mandrel engaging an end of the camming sleeve and means for bursting the ring in hoop tension upon application of sufficient axial force between the mandrel and camming sleeve.

* * * * *